US007334365B2

(12) United States Patent
Kim

(10) Patent No.: US 7,334,365 B2
(45) Date of Patent: Feb. 26, 2008

(54) ACCESSORY MOUNT FOR A FIREARM

(75) Inventor: Paul Y. Kim, Santa Ana, CA (US)

(73) Assignee: Surefire, LLC, Fountain Valley, CA (US)

( * ) Notice: Subject to any disclaimer, the term of this patent is extended or adjusted under 35 U.S.C. 154(b) by 476 days.

(21) Appl. No.: 11/040,042

(22) Filed: Jan. 20, 2005

(65) Prior Publication Data

US 2006/0156609 A1 Jul. 20, 2006

(51) Int. Cl.
*F41G 1/387* (2006.01)

(52) U.S. Cl. ..... 42/124

(58) Field of Classification Search ..... 42/85, 42/124–127

See application file for complete search history.

(56) References Cited

U.S. PATENT DOCUMENTS

| | | | | |
|---|---|---|---|---|
| 1,338,239 | A | 4/1920 | Matys | |
| 2,450,584 | A | 10/1948 | Dodge | |
| 3,584,533 | A | 6/1971 | Allyn | |
| 3,901,125 | A | 8/1975 | Rayille | |
| 4,313,272 | A | 2/1982 | Matthews | |
| 4,344,246 | A | 8/1982 | Bauman et al. | |
| 4,418,487 | A | 12/1983 | Strahan | |
| 4,542,447 | A | 9/1985 | Quakenbush | |
| 4,777,754 | A | 10/1988 | Reynolds, Jr. | |
| 4,856,218 | A | 8/1989 | Reynolds, Jr. | |
| 4,934,085 | A * | 6/1990 | Lough | 42/127 |
| 4,959,908 | A * | 10/1990 | Weyrauch | 42/124 |
| 5,107,612 | A * | 4/1992 | Bechtel | 42/115 |
| 5,208,826 | A | 5/1993 | Kelly | |
| 5,299,375 | A | 4/1994 | Thummel et al. | |
| 5,323,555 | A | 6/1994 | Jehn | |
| 5,388,364 | A | 2/1995 | Paldino | |
| 5,430,967 | A | 7/1995 | Woodman, III et al. | |
| 5,457,901 | A | 10/1995 | Gernstein et al. | |
| 5,471,777 | A | 12/1995 | McDonald | |
| 5,522,167 | A | 6/1996 | Teetzel | |
| 5,581,898 | A | 12/1996 | Thummel | |
| 5,584,137 | A | 12/1996 | Teetzel | |
| 5,621,999 | A | 4/1997 | Moore | |
| 5,628,555 | A | 5/1997 | Sharrah et al. | |
| 5,654,594 | A | 8/1997 | Bjornsen, III et al. | |
| 5,669,174 | A | 9/1997 | Teetzel | |
| 5,758,448 | A | 6/1998 | Thummel | |
| 5,768,819 | A | 6/1998 | Neal | |
| 5,816,683 | A | 10/1998 | Christiansen | |
| 5,930,935 | A | 8/1999 | Griffin | |
| 6,023,875 | A | 2/2000 | Fell et al. | |
| 6,378,237 | B1 | 4/2002 | Matthews et al. | |
| 6,705,038 | B2 | 3/2004 | Davenport et al. | |
| 6,931,779 | B1 * | 8/2005 | Galuppo, Jr. | 42/127 |
| 7,117,624 | B2 * | 10/2006 | Kim | 42/85 |
| 7,117,627 | B2 * | 10/2006 | Woodmansee et al. | 42/146 |
| 7,134,234 | B1 * | 11/2006 | Makarounis | 42/146 |
| 7,188,978 | B2 * | 3/2007 | Sharrah et al. | 362/396 |
| 2001/0022044 | A1 * | 9/2001 | Spinner | 42/124 |

* cited by examiner

*Primary Examiner*—Troy Chambers
(74) *Attorney, Agent, or Firm*—David Weiss

(57) ABSTRACT

An accessory mount removably securable to a firearm, the mount including a rail adapted for removably mounting an accessory thereto. The accessory mount of the preferred embodiment includes two structural members that are releasably securable to one another for removable securement to two longitudinally extending depressions along the frame of the firearm.

26 Claims, 3 Drawing Sheets

ACCESSORY MOUNT FOR A FIREARM

BACKGROUND OF THE INVENTION

This invention relates to accessory mounts for mounting an accessory to a firearm, and more particularly to a mount or interface adapter for removably securing a light beam generator apparatus to a firearm including a handgun.

Light beam generator apparatus, such as flashlights and laser aiming devices, have long been adapted for being secured to firearms as target illuminators and laser sights. For example, U.S. Pat. No. 4,777,754, issued to Edward C. Reynolds, Jr. and assigned to the assignee of the present invention, teaches a light beam generator assembly mounted to a firearm below the firearm's barrel and forwardly of the firearm's trigger guard. Reynolds U.S. Pat. No. 4,777,754 is incorporated herein by reference.

U.S. Pat. No. 6,378,237, issued to John W. Matthews and Paul Y. Kim and assigned to the assignee of the present invention, discloses an accessory mount or interface adapter clamped to the front of the handgun's trigger guard and longitudinally extending beneath the handgun's barrel. The accessory mount includes a rail having a pair of longitudinal grooves, one along each side of the rail, and the light beam generator apparatus includes a pair of longitudinal tongues for slidably mating with the mount's longitudinal grooves for being slidably held along the rail. A latch on the light beam generator housing co-acts with a transverse slot in the rail to releasably prevent further longitudinal movement of the light beam generator apparatus when such apparatus is at a predetermined position along the rail. Matthews et al. U.S. Pat. No. 6,378,237 is incorporated herein by reference.

SUMMARY OF THE INVENTION

By the present invention, there is provided an accessory mount or interface adapter having a rail for mounting a rail mountable accessory (in particular a light beam generator apparatus) to a firearm having respective longitudinal depressions along opposite sides of the firearm's frame. The preferred embodiment of the accessory mount is removably securable to a firearm such as a USP handgun manufactured by Heckler & Koch Inc.

According to an aspect of the present invention, there is provided an accessory, mount for mounting an accessory device to a firearm, the firearm including a longitudinal barrel, a frame, and a longitudinal first depression and a longitudinal second depression respectively along opposite sides of the frame, the accessory mount comprising the combination of: a first structural member and a second structural member adapted to be releasably secured to one another; the first structural member including a longitudinal rail adapted for removably securing the accessory device thereto, the first structural member including a portion upwardly projecting from one side of the rail and having a longitudinally extending first protuberance configured for being received by the first depression; and the second structural member including a portion upwardly projecting from the other side of the rail when the first structural member and the second structural member are secured to one another, such portion having a longitudinally extending second protuberance configured for being received by the second depression when the first protuberance is received by the first depression with the first structural member and the second structural member secured to one another and the rail longitudinally extending beneath the barrel.

A preferred embodiment of the present invention is provided by an accessory mount for mounting an accessory device to a firearm, the firearm including a longitudinal barrel, a frame, and a longitudinal first depression and a longitudinal second depression along opposite sides of the frame, the accessory mount comprising the combination of: a first structural member including a longitudinal rail adapted for removably securing the accessory device thereto, a first section extending rearwardly of a portion of the width of the rail toward one side of the rail, and a first arm upwardly projecting from the first section along such side and including a longitudinally extending first protuberance configured for being received by the first depression; a second structural member including a second section configured for being placed to the first section and rearwardly of another portion of the width of the rail toward the other side of the rail, and a second arm upwardly projecting from the second section and including a longitudinally extending second protuberance configured for being received by the second depression; and the first structural member and the second structural member being adapted to be releasably secured to one another with the first protuberance received by the first depression, the second protuberance received by the second depression, and the rail longitudinally extending beneath the barrel.

In the preferred embodiment, the first section and the second section are adapted to be releasably secured to one another for releasably securing the first structural member and the second structural member to one another. At least one fastener (and preferably two fasteners) cooperates with the first section and the second section for releasably securing the first section and the second section to one another.

According to a further aspect of the present invention, there is provided firearm and accessory mount apparatus comprising in combination: a firearm including a longitudinal barrel, a frame and a longitudinal first depression and a longitudinal second depression respectively along opposite sides of the frame; a first structural member including a rail adapted for removably securing an accessory device thereto, the rail longitudinally extending beneath the barrel, the first structural member including a portion upwardly projecting from one side of the rail and having a longitudinally extending first protuberance received by the first depression; a second structural member releasably secured to the first structural member, the second structural member upwardly projecting from the other side of the rail and having a longitudinally extending second protuberance received by the second depression; and a fastener releasably securing the first structural member and the second structural member to one another.

The preferred embodiment of the firearm and accessory mount apparatus combination of the present invention comprises: a firearm including a longitudinal barrel, a frame, and a longitudinal first depression and a longitudinal second depression respectively along opposite sides of the frame; a first structural member including a rail adapted for removably securing an accessory device thereto, the rail longitudinally extending beneath the barrel, the first structural member including a first section extending rearwardly of a portion of the width of the rail toward one side of the rail, and a first arm upwardly projecting from the first section along such one side and including a longitudinally extending first protuberance received by the first depression; a second structural member including a second section rearwardly of another portion of the width of the rail toward the other side of the rail, a second arm upwardly projecting from the second section and including a longitudinally extending second protuberance received by the second depression; and the first structural member and the second structural member being releasably secured to one another.

BRIEF DESCRIPTION OF THE DRAWINGS

The novel features believed to be characteristic of the invention, together with further advantages thereof, will be better understood from the following description considered in connection with the accompanying drawings in which a preferred embodiment of the present invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
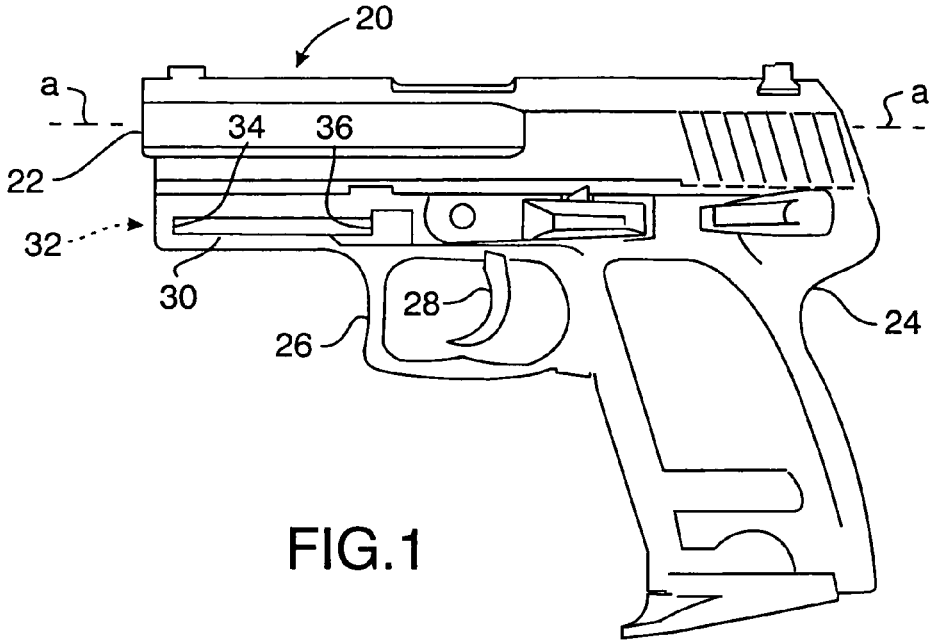
FIG. 1 is a side elevation view of a firearm, specifically a handgun.

Turning to the drawings, there is illustrated in FIG. 1 an example of a firearm 20, specifically a USP Compact handgun manufactured by Heckler & Koch Inc. The firearm 20 includes a barrel 22 extending along a longitudinal axis a from the handgun's frame 24, and includes a trigger guard 26 in front of the handgun's trigger 28.

Figure 7:
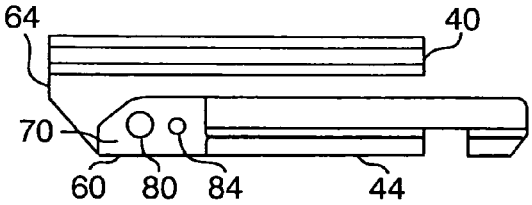
FIG. 7 is a right side elevation view of the first structural member of FIG. 6.

As used herein, the word "longitudinal" describes a direction parallel to the axis a; "transverse" describes a horizontal direction perpendicular to the axis a when the barrel 22 is horizontally positioned; "above" means vertically above when the handgun 20 is held with its barrel 22 horizontal; "above" means vertically above when the handgun 20 is held with its barrel 22 horizontal; "below" or "beneath" means vertically below when the handgun 20 is held with the barrel 22 horizontal; "front" or "forward" describes the direction toward the muzzle of the barrel 22 from the trigger 28 (i.e., to the left as shown in FIGS. 1-3, 5, 6, 8, 15 and 17, and to the right as viewed in FIGS. 7 and 9); "rear" or "rearward" describes the direction opposite the front or forward direction; "left" means to the left when forwardly viewed from the rear of the firearm 20; and "right" means to the right when forwardly viewed from the rear of the firearm 20.

Returning to FIG. 1, the firearm or handgun 20 includes a first longitudinal groove or depression 30 along one side (such as the left side) of the frame 24, and a second longitudinal groove or depression 32 (see also FIG. 4) along the other side (such as the right side) of the frame 24. Each of the longitudinal depressions 30, 32 includes a front end wall 34 and a rear end wall 36.

Figure 2:
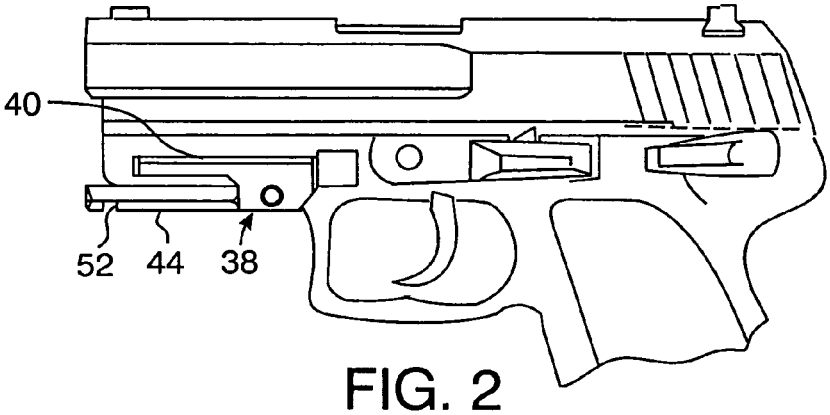
FIG. 2 is a side elevation view of the firearm of FIG. 1 with a preferred embodiment of an accessory mount or interface adapter according to the present invention secured thereto.
Figure 4:
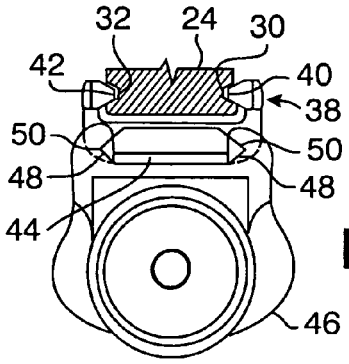
FIG. 4 is a front view of the accessory mount with secured light beam generator shown in FIG. 3 (in increased scale), secured to the firearm shown in fragmentary cross-section.
Figure 5:
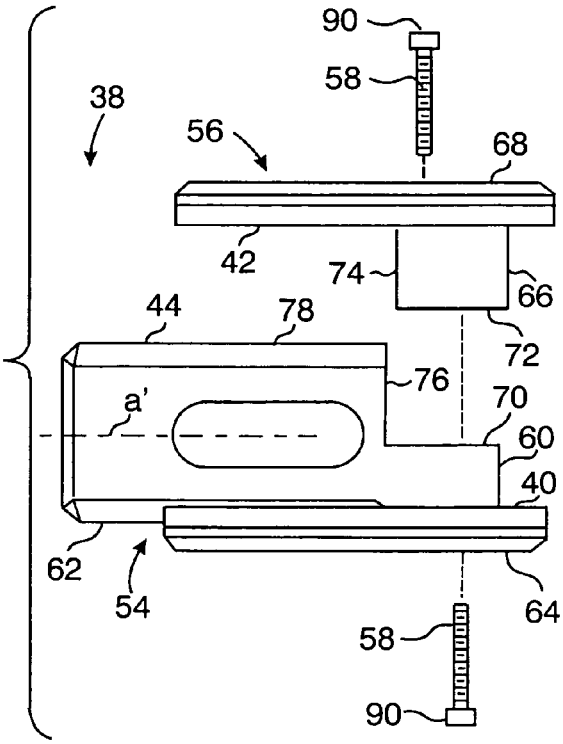
FIG. 5 is an exploded top plan view of the accessory mount shown in FIGS. 2-4 (in increased scale) showing a first structural member and a second structural member in position for being secured together.
Figure 6:
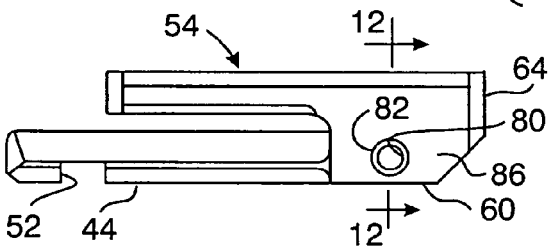
FIG. 6 is a left side elevation view of the first structural member included in the accessory mount shown in FIG. 5.
Figure 8:
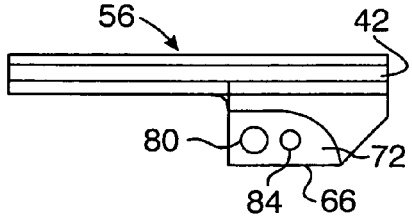
FIG. 8 is a left side elevation view of the second structural member shown in FIG. 5.

As shown in FIGS. 2 and 4, a preferred embodiment of an accessory mount or interface adapter 38 according to the present invention is secured to the handgun frame 24, specifically by two inwardly facing longitudinally extending protuberances 40, 42 fittingly received by the outwardly facing longitudinal depressions 30, 32, respectively, between the front and rear end walls 34, 36 of each of the longitudinal depressions 30, 32.

Figure 3:
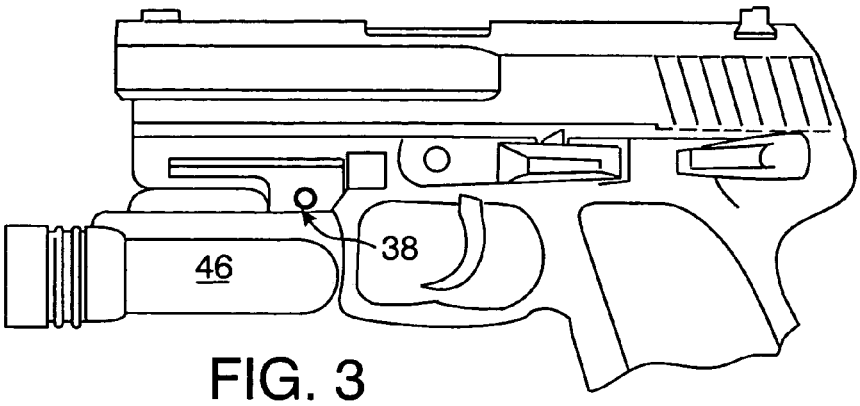
FIG. 3 is similar to FIG. 2, except that a light beam generator apparatus is shown mounted to the accessory mount.

When the accessory mount 38 is so secured to the handgun 20, a rail 44 included by the accessory mount 38 longitudinally extends beneath the barrel 22. After the accessory mount 38 has been installed on the handgun 20, a firearm accessory such as a light beam generator apparatus or light module 46 may be mounted to the accessory mount 38. For example, as shown in FIGS. 3 and 4, the light module 46 may include a pair of longitudinal grooves 48 for slidably mating with respective longitudinal tongues 50 of the accessory mount's rail 44. A latch on the light beam generator housing may co-act with a transverse slot 52 in the rail for releasably preventing further longitudinal movement of the light beam generator 46 along the rail 44 when the light beam generator 46 is at a predetermined position along the rail 44. Light beam generators of this type are shown in the aforementioned U.S. Pat. No. 6,378,237 incorporated herein by reference.

Turning to FIGS. 5-13, the accessory mount 38 includes a first structural member 54 and a second structural member 56 adapted to be releasably secured to one another such as by headed screws 58 cooperatively engaging the structural members 54, 56 as will be more fully explained below.

The first structural member 54 includes the rail 44 extending along the longitudinal axis a'. The first structural member 54 further includes a first section 60 extending rearwardly of a portion of the rail's width (i.e. the rail dimension transverse to the longitudinal axis a') toward one side 62 of the rail 44. The first section 60 is preferably substantially rectangular with its upper surface extending in substantially the same plane (in at least the forward portion of the section 60) as the upper surface of the rail 44, the section 60 forming an "L" shape with the rail 44, and the thickness of the section 60 being substantially the same (in at least the forward portion of the section 60) as the thickness (the dimension from upper surface to lower surface) of the rail 44.

The first structural member 54 includes a first arm 64 upwardly projecting from the section 60 (see, in particularly, FIGS. 6, 7, 10 and 12) along the one side 62 of the rail 44. The arm 64 includes the longitudinally extending, inwardly directed first tongue or protuberance 40.

The second structural member 56 includes a second section 66, preferably substantially rectangular and of thickness substantially the same as the thickness of the first section 60, and dimensioned for fitting into the "L" of the first structural member 54. The second structural member 56 further includes a second arm 68 upwardly projecting from the second section 66 including the longitudinally extending, inwardly directed tongue or second protuberance 42.

The second section 66 is dimensioned such that the second structural member 56 may be placed to the first structural member 54 with the inner longitudinal face 70 of the first section 60 and the inner longitudinal face 72 of the second section 66 transversely engaging or contacting one another. Upon such occurrence, the forward transverse face 74 of the second section 66 faces, either contacting or preferably just rearwardly of, the rear face 76 along the rail's remaining width portion toward the other side 78 of the rail 44, with the first and second arms 64, 68 substantially equally transversely spaced from the longitudinal axis a' and the inwardly facing first and second longitudinal protuberances 40, 42 substantially equally transversely spaced from the longitudinal axis a'.

The first and second structural members 54, 56 are secured together when thusly positioned, such as by utilization of a fastener cooperating with the first and second sections 60, 66 releasably securing the first and second sections 60, 66 to one another.

At least one of the sections 54, 56 includes a transverse bore therethrough aligned with an internally threaded blind transverse bore in the other section, the two sections being releasably secured to each other by a headed screw 58 extending through the bore through the one section and threaded to the aligned threaded bore in the other section. Preferably, two such bore/threaded bore and screw combinations are utilized.

Figure 9:
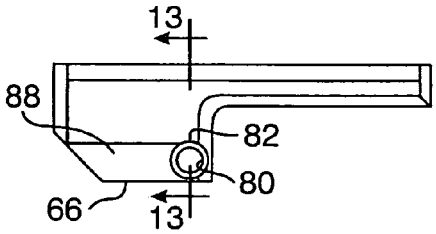
FIG. 9 is a right side elevation view of the second structural member shown in FIG. 8.
Figure 10:
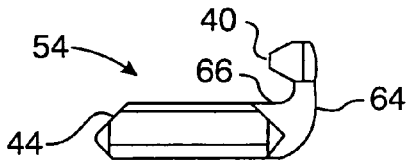
FIG. 10 is a front elevation view of the first structural member shown in FIGS. 5-7.
Figure 12:
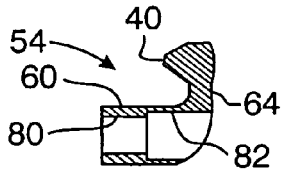
FIG. 12 is a cross-sectional view of the first structural member shown in FIGS. 5-7, taken along the line 12-12 of FIG. 6 and viewed in the direction of the appended arrows.
Figure 11:
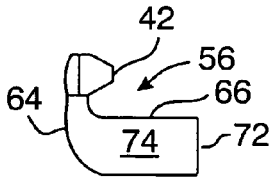
FIG. 11 is a front elevation view of the second structural member shown in FIGS. 5,8 and 9.
Figure 13:
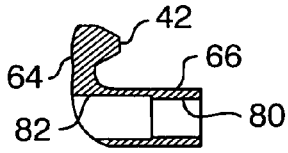
FIG. 13 is a cross-sectional view of the second structural element shown in FIGS. 5, 8 and 9, taken along the line 13-13 of FIG. 9 and viewed in the direction of the appended arrows.
Figure 14:
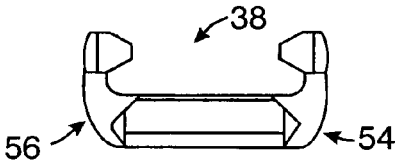
FIG. 14 is a front view of the assembled accessory mount, i.e. the secured-together first and second structural members shown in FIG. 5.
Figure 15:
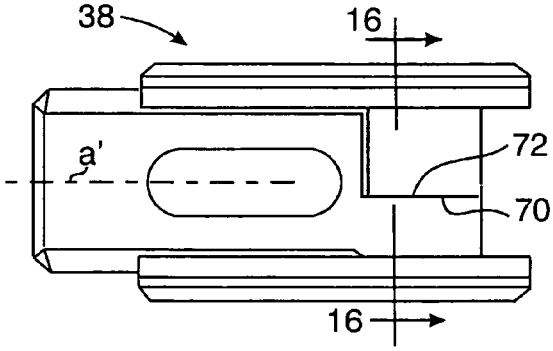
FIG. 15 is a top plan view of the assembled accessory mount of FIG. 14.
Figure 16:
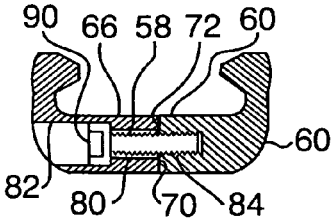
FIG. 16 is a cross-sectional view of the assembled accessory mount of FIG. 15, taken along the line 16-16 of FIG. 15 and viewed in the direction of the appended arrows.

Specifically, in the preferred embodiment of the accessory mount 38 shown in the drawings (see in particularly FIGS. 12, 13, 16 and 17), each of the first and second sections 54, 56 includes a transverse bore 80 and counterbore 82, as well as a transverse threaded bore 84 transversely aligned with the bore 80 in the other of the sections 54, 56, so that one of the counterbores 82 opens to the outer longitudinal face 86 of the first section 60 (see also FIG. 6) and the other counterbore 82 opens to the outer longitudinal face 88 of the second section 66 (see also FIG. 9). When fastening the two structural members 54, 56 together, one of the screws 58 is inserted through one of the counterbore/bore combinations 82, 80 in the first section 60 and threadedly cooperates with the aligned threaded bore 84 in the second section 66, while the other of the screws 58 is inserted through the other of the counterbore/bore combinations 82, 80 in the second section 66 threadedly cooperating with the aligned threaded bore 84 in the first section 60. The screws are thereupon tightened until the screw heads 90 are urged against the respective peripheral annular ledges of the counterbores 82 while the inner faces 70, 72 of the respective first and second sections 60, 66 are in contact engagement (see, in particular, FIGS. 15 and 16).

When securing the accessory mount 38 to the handgun 20, the user places the first structural member 54 to the handgun 20 with the longitudinal rail 44 beneath the barrel 22, with the axis a' parallel to and beneath the axis a, and with the longitudinally extending protuberance 40 inserted in the elongate depression 30 of the handgun's frame 24. The user also places the accessory mount's second structural member 56 to the handgun 20 with the second longitudinally extending protuberance 42 inserted in the second longitudinal depression 32 of the handgun frame 24, and with the inner faces 70 and 72 of the first and second structural member sections 60 and 66 facing one another. The headed screws 58 are inserted in their respective counterbore/bore and threaded bore combinations 82, 80, 84 and tightened as previously described. Such dual screw arrangement prevents pivoting of the two sections 60, 66 (and hence of the two structural members 54, 56) with respect to one another, such as pivoting about a transverse axis.

The lengths of longitudinal protuberances 40, 42 are preferably slightly less than the lengths of the respective longitudinal depressions 30, 32, so that the protuberances 40, 42 just fit between the front and rear walls 34, 36 of the longitudinal depressions 30, 32. When installed to the handgun 20, the accessory mount 38 is vertically retained by the depressions 30, 32 of the handgun frame 24 while being constrained as well against longitudinal and transverse movement with respect to the handgun frame 24.

Figure 17:
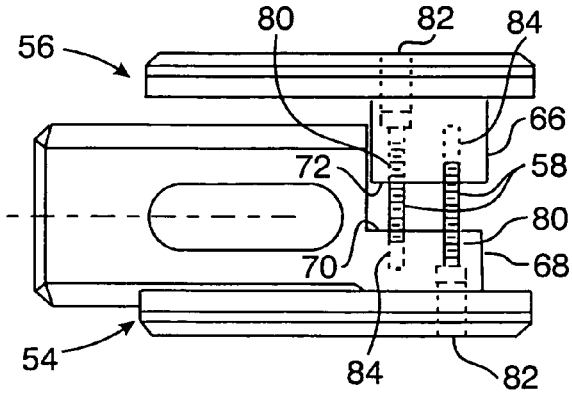
FIG. 17 is a top plan view of the accessory mount of FIG. 5 with the first and second structural members shown in a release position.

When the accessory mount 38 is not installed on the handgun 20, or while being placed to and removed from the handgun 20, the two structural members 54, 56 may nevertheless be retained to one another if desired. The length of the threaded bores 84 with respect to the length of the shafts of the headed screws 58 are preferably related such that an end portion of each threaded screw 58 is threadedly retained by its threaded bore 84 when the two structural members are held apart such that the transverse separation between the two protuberances 40, 42 is greater than the width of the handgun frame 24 beneath the handgun's longitudinally extending depressions 30, 32. Such disposition of the two structural members 54, 56 is shown in FIG. 17, and the combination of the two structural members 54, 56 as so disposed may be placed to the handgun 20 whereupon the user urges the two structural members 54, 56 transversely toward one another until the protuberances 40, 42 are received by their respective depressions 30, 32. The user then tightens the screws 58 for completing the installation of the accessory mount 38 to the handgun frame 24.

The user may release the first and second structural members 54, 56 from one another for removing the accessory mount 38 from the handgun 20, by unscrewing the screws 58 until the two structural members 54, 56 may be held apart such that the two protuberances 40, 42 are separated by a distance greater than the width of the handgun frame 24 beneath the depressions 30, 32 and thereby transversely withdrawn from the two depressions 30, 32, whereupon the user may downwardly and forwardly remove the accessory mount 38 from the handgun 20.

If desired, of course, the user may continue releasing the two structural members 54, 56 from one another by continuing to unscrew the screws 58 until the two structural members 54, 56 are completely removed from one another. In such event, the user may transversely withdraw the two protuberances 40, 42 from their respective depressions 30, 32 and thereby remove the two structural members 54, 56 of the accessory mount 38 from the handgun 20.

Each of the structural members 54, 56 of the accessory mount 38 of the present invention may be made using fabrication methods well known in the art, of well known materials typically used in the art of making firearm accessory mounts including rigid and durable materials such as polymeric materials as well as lightweight aluminum alloys.

Thus, there has been described a preferred embodiment of an accessory mount removably securable to a firearm, the mount including a longitudinal rail adapted for removably mounting an accessory thereto. The accessory mount of the preferred embodiment includes two structural members that are releasably securable to one another for removable securement to two longitudinally extending depressions along the frame of the firearm. Other embodiments of the present invention, and variations of the embodiments described herein may be developed without departing from the essential characteristics thereof. Accordingly, the invention should be limited only by the scope of the claims set forth below.

I claim:

1. For combination with a firearm, an accessory mount for mounting an accessory device to the firearm, the firearm including a longitudinal barrel, a frame, and a longitudinal first depression and a longitudinal second depression respectively along opposite sides of the frame, the accessory mount comprising the combination of:

a first structural member and a second structural member adapted to be releasably secured to one another;

said first structural member including a longitudinal rail adapted for removably securing the accessory device thereto, said first structural member including a portion upwardly projecting from one side of said rail and having a longitudinally extending first protuberance configured for being received by the first depression; and said second structural member upwardly projecting from the other side of said rail when said first structural member and said second structural member are secured to one another, said second structural member having a longitudinally extending second protuberance configured for being received by the second depression when said first protuberance is received by the first depression with said first structural member and said second structural member secured to one another and said rail longitudinally extending beneath the barrel.

2. The accessory mount according to claim 1, the firearm including a trigger guard and the first and second longitudinal depressions extending forwardly of the trigger guard, wherein:

said rail extends forwardly of said trigger guard when said first structural member and said second structural member are secured to one another with said first protuberance received by the first depression and said second protuberance received by the second depression.

3. The accessory mount according to claim 1, wherein:

said first protuberance is configured for being transversely received by the first depression and said second protuberance is configured for being transversely received by the first depression during securement of said first and second structural members to one another.

4. The accessory mount according to claim 3, wherein:

said first protuberance is configured for being transversely withdrawn from the first depression and said second protuberance is configured for being transversely withdrawn from the second depression during release of the securement of said first structural member and said second structural member.

5. The accessory mount according to claim 1, wherein:

said first protuberance is configured for being fittingly received by the first depression and said second protuberance is configured for being fittingly received by the second depression.

6. For combination with a firearm, an accessory mount for mounting an accessory device to the firearm, the firearm including a longitudinal barrel, a frame, and a longitudinal first depression and a longitudinal second depression respectively along opposite sides of the frame, the accessory mount comprising the combination of:

a first structural member including a longitudinal rail adapted for removably securing the accessory device thereto, a first section extending rearwardly of a portion of the width of said rail toward one side of said rail, and a first arm upwardly projecting from said first section along said one side and including a longitudinally extending first protuberance configured for being received by the first depression;

a second structural member including a second section configured for being placed to said first section and rearwardly of another portion of said width of said rail toward the other side of said rail, and a second arm upwardly projecting from said second section and including a longitudinally extending second protuberance configured for being received by the second depression; and said first structural member and said second structural member being adapted to be releasably secured to one another with said first protuberance received by the first depression, said second protuberance received by the second depression and said rail longitudinally extending beneath the barrel.

7. The accessory mount according to claim 6, wherein:

said first section and said second section are adapted to be releasably secured to one another for releasably securing said first structural member and said second structural member to one another.

8. The accessory mount according to claim 7, including:

at least one fastener cooperating with said first section and said second section for releasably securing said first section and said second section to one another.

9. The accessory mount according to claim 7, including:

at least one fastener transversely cooperating with said first section and said second section for releasably securing said first section and second section to one another.

10. The accessory mount according to claim 6, wherein:

one of said sections includes a transverse bore therethrough and the other of said sections includes a transverse threaded bore, said accessory mount including a screw extending through said bore in said one of said sections and threaded to said threaded bore in said other of said sections for releasably securing said first structural member and said second structural member to one another.

11. The accessory mount according to claim 10, wherein:

said other of said sections includes a transverse bore therethrough and said one of said sections includes a transverse threaded bore, said accessory mount including a second screw extending through said bore in said other of said sections and threaded to said threaded bore in said one of said sections for releasably securing said first structural member and said second structural member to one another.

12. The accessory mount according to claim 11, wherein:

the length of said threaded bores are related to the length of said screws such that end portions of said threaded screws are threadedly retained by said threaded bores respectively when said first structural member and said second structural member are transversely separated with the distance between said first protuberance and said second protuberance greater than the width of the frame of the handgun beneath the depressions.

13. The accessory mount according to claim 6, the firearm including a trigger guard and the first and second longitudinal depressions extending forwardly of the trigger guard, wherein:

said rail extends forwardly of said trigger guard when said first structural member and said second structural member are secured to one another with said first protuberance received by the first depression and said second protuberance received by the second depression.

14. The accessory mount according to claim 6, wherein:

said first protuberance is configured for being fittingly received by the first depression and said second protuberance is configured for being fittingly received by the second depression.

15. Firearm and accessory mount apparatus, comprising in combination:

a firearm including a longitudinal barrel, a frame, and a longitudinal first depression and a longitudinal second depression respectively along opposite sides of said frame;

a first structural member including a rail adapted for removably securing an accessory device thereto, said rail longitudinally extending beneath said barrel, said first structural member including a portion upwardly projecting from one side of said rail and having a longitudinally extending first protuberance received by said first depression;

a second structural member releasably secured to said first structural member, said second structural member upwardly projecting from the other side of said rail and having a longitudinally extending second protuberance received by said second depression; and a fastener releasably securing said first structural member and said second structural member to one another.

16. The apparatus according to claim 15, wherein:

said first protuberance is fittingly received by said first depression and said second protuberance is fittingly received by said second depression.

17. The apparatus according to claim 15, wherein:

the firearm includes a trigger guard; and said first structural member and said structural member are situated forwardly of said trigger guard.

18. Firearm and accessory mount apparatus, comprising in combination:

a firearm including a longitudinal barrel, a frame, and a longitudinal first depression and a longitudinal second depression respectively along opposite sides of said frame;

a first structural member including a rail adapted for removably securing an accessory device thereto, said rail longitudinally extending beneath said barrel, said first structural member including a first section extending rearwardly of a portion of the width of said rail toward one side of said rail, and a first arm upwardly projecting from said first section along said one side and including a longitudinally extending first protuberance received by said first depression;

a second structural member including a second section rearwardly of another portion of said width of said rail toward the other side of said rail, a second arm upwardly projecting from said second section and including a longitudinally extending second protuberance received by said second depression; and said first structural member and said second structural member being releasably secured to one another.

19. The apparatus according to claim 18, wherein:

said first section and said second section are releasably secured to one another for releasably securing said first structural member and said second structural member to one another.

20. The apparatus according to claim 19, including:

at least one fastener cooperating with said first section and said second section for releasably securing said first section and said second section to one another.

21. The accessory mount according to claim 19, including:

at least one fastener transversely cooperating with said first section and said second section for releasably securing said first section and said second section to one another.

22. The apparatus according to claim 18, wherein:

one of said sections includes a transverse bore therethrough and the other of said sections includes a transverse threaded bore, the apparatus including a screw extending through said bore in said one of said sections and threaded to said threaded bore in said other of said sections for releasably securing said first structural member and said second structural member to one another.

23. The apparatus according to claim 22, wherein:

said other of said sections includes a transverse bore therethrough and said one of said sections includes a transverse threaded bore, the apparatus including a second screw extending through said bore in said other of said sections and threaded to said threaded bore in said one of said sections for releasably securing said first structural member and said second structural member to one another.

24. The apparatus according to claim 23, wherein:

the length of said threaded bores are related to the length of said screws such that end portions of said threaded screws are threadedly retained by said threaded bores respectively when said first structural member and said second structural member are transversely separated with the distance between said first protuberance and said second protuberance greater than the width of said frame beneath said depressions.

25. A method of installing an accessory mount to a firearm, comprising:

providing a firearm including a longitudinal barrel, a frame, and a longitudinal first depression and a longitudinal second depression respectively along opposite sides of said frame;

providing a first structural member including a rail adapted for removably securing an accessory device thereto, said first structural member including a portion upwardly projecting from one side of said rail and having a longitudinally extending first protuberance;

providing a second structural member including a longitudinally extending second protuberance;

placing said first structural member and said second structural member to said firearm with said rail longitudinally extending beneath said barrel, said first protuberance received by said first depression, and said second protuberance received by said second depression; and fastening said first and second structural members to one another.

26. A method of installing an accessory mount to a firearm, comprising:

providing a firearm including a longitudinal barrel, a frame, and a longitudinal first depression and a longitudinal second depression respectively along opposite sides of said frame;

providing a first structural member including a rail for removably securing an accessory device thereto, said first structural member including a first section extending rearwardly of a portion of the width of said rail toward one side of said rail, and a first arm upwardly projecting from said first section along said one side and including a longitudinally extending first protuberance;

providing a second structural member including a second section and a second arm upwardly projecting from said second section and including a longitudinally extending second protuberance;

placing said first structural member and said second structural member to said firearm with said rail longitudinally extending beneath said barrel, said first protuberance received by said first depression, and said second protuberance received by said second depression; and releasably securing said first section and said second section to one another.

* * * * *

UNITED STATES PATENT AND TRADEMARK OFFICE

CERTIFICATE OF CORRECTION

PATENT NO. : 7,334,365 B2
APPLICATION NO. : 11/040042
DATED : February 26, 2008
INVENTOR(S) : Paul Y. Kim It is certified that error appears in the above-identified patent and that said Letters Patent is hereby corrected as shown below:

Title page, Item [56], U.S. PATENT DOCUMENTS,

In the line for 3,901,125, "Rayille" should be --Raville--;

Add:
--6,591,536 7/2003 Houde-Walter et al.--.

Signed and Sealed this

Seventeenth Day of June, 2008

JON W. DUDAS
*Director of the United States Patent and Trademark Office*